US010556358B2

(12) United States Patent
Boerman et al.

(10) Patent No.: US 10,556,358 B2
(45) Date of Patent: Feb. 11, 2020

(54) PERFORATION SYSTEM AND METHOD

(71) Applicant: Eagle Ottawa North America, LLC, Auburn Hills, MI (US)

(72) Inventors: Scott Alan Boerman, Lapeer, MI (US); Douglas Steven Sculthorpe, El Paso, TX (US)

(73) Assignee: Eagle Ottawa North America, LLC, Auburn Hills, MI (US)

( * ) Notice: Subject to any disclaimer, the term of this patent is extended or adjusted under 35 U.S.C. 154(b) by 744 days.

(21) Appl. No.: 14/925,091

(22) Filed: Oct. 28, 2015

(65) Prior Publication Data

US 2016/0129605 A1 May 12, 2016

Related U.S. Application Data

(60) Provisional application No. 62/078,111, filed on Nov. 11, 2014.

(51) Int. Cl.

| | |
|---|---|
| ***B26F 1/14*** | (2006.01) |
| ***B26D 7/01*** | (2006.01) |
| ***B26D 5/00*** | (2006.01) |

(52) U.S. Cl.

CPC ..... *B26F 1/14* (2013.01); *B26D 5/005* (2013.01); *B26D 7/015* (2013.01); *Y10T 83/8732* (2015.04)

(58) Field of Classification Search

CPC ..... Y10T 83/0524; Y10T 83/2092; Y10T 83/2096; Y10T 83/2109; Y10T 83/2124; Y10T 83/2127; Y10T 83/2155; Y10T 83/2157; Y10T 83/6484; Y10T 83/814; Y10T 83/822; Y10T 83/8732; Y10T 83/8727; Y10T 83/8729; Y10T 83/873; Y10T 83/9382; Y10T 83/9387; Y10T 83/9423; Y10T 83/943; B26F 1/14; B26F 1/00; B26F 1/02; B26F 1/04; B26F 1/40; B26F 1/44; B26D 5/005; B26D 7/015

See application file for complete search history.

(56) References Cited

U.S. PATENT DOCUMENTS

| | | | | |
|---|---|---|---|---|
| 2,168,377 A * | 8/1939 | Wales | B21D 45/006 | 83/140 |
| 2,240,139 A * | 4/1941 | Kaailau | B21D 28/02 | 83/124 |
| 3,098,292 A * | 7/1963 | Bunk | B21D 28/02 | 29/412 |

(Continued)

FOREIGN PATENT DOCUMENTS

| | | |
|---|---|---|
| DE | 102005000786 A1 | 7/2006 |
| DE | 10300831 B4 | 10/2006 |

OTHER PUBLICATIONS

German Patent and Trademark Office, First Office Action for the corresponding German Patent Application No. 10 2015 222 178.4 dated Sep. 14, 2016.

*Primary Examiner* — Phong H Nguyen

(74) *Attorney, Agent, or Firm* — Brooks Kushman P.C.

(57) ABSTRACT

A perforation system and method of perforating a flexible work piece. The perforation system includes a punch tool having at least one punch head defining a vertical axis. The punch head has a first shape. A die is positioned along the vertical axis and includes an ejection port having a second shape. The first shape overlaps the second shape to provide for punch-to-die contact that results in a clean cut along a perimeter of the second shape.

20 Claims, 5 Drawing Sheets

(56) References Cited

U.S. PATENT DOCUMENTS

| | | | | | |
|---|---|---|---|---|---|
| 3,555,949 | A * | 1/1971 | Treff | B26D 7/025 | 83/125 |
| 3,779,113 | A * | 12/1973 | Jestin | B21D 28/24 | 83/140 |
| 3,850,059 | A * | 11/1974 | Kang | B26D 3/085 | 83/346 |
| 4,261,237 | A * | 4/1981 | DiDonato, Jr. | B21D 28/34 | 83/139 |
| 4,993,295 | A * | 2/1991 | Dacey, Jr. | B21D 45/006 | 83/140 |
| 5,048,385 | A * | 9/1991 | Eckert | B21D 28/12 | 83/34 |
| 5,836,226 | A * | 11/1998 | Tsuji | B21D 28/265 | 83/129 |
| 6,311,594 | B1 * | 11/2001 | Ootsuka | B21D 45/006 | 83/138 |
| 2004/0046285 | A1 * | 3/2004 | Tanii | H01G 4/30 | 264/320 |
| 2006/0060046 | A1 * | 3/2006 | Sugizaki | B21D 28/26 | 83/138 |

* cited by examiner

PERFORATION SYSTEM AND METHOD

CROSS-REFERENCE TO RELATED APPLICATIONS

This application claims the benefit of U.S. provisional application Ser. No. 62/078,111 filed Nov. 11, 2014, the disclosure of which is hereby incorporated in its entirety by reference herein.

TECHNICAL FIELD

This disclosure relates to a perforation system and a method of perforating a work piece.

BACKGROUND

Automatic machines for perforating sheets of material are known in the art. Perforation processes are used to make sheets of material breathable or to give a specific aesthetic look to the material. For example, in the leather industry, producing incisions or perforations that create a well-defined geometric pattern on the surface of the product (e.g., automobile seat cover) may be desired.

Conventional perforation machines typically include a conveyor belt that unwinds between two rollers placed at opposite sides of the machine and upon which the sheet of material to be perforated lays. The conveyor belt feeds the sheet of material through a punch tool and die assembly mounted to a tool saddle. The machine controls the punch tool and saddle to repeatedly perforate the sheet of material as it is translated through the machine by the conveyor belt. However, such perforation machines are limited by the fixed size and spacing relationship of the punch tooling, which reduces the ability to customize the perforation patterns on the sheet of material. Moreover, punching through a soft sheet of material often fails to provide a clean cut, resulting in excess undesirable material remaining attached to the sheet of material.

Alternatively, perforation dies can be used to perforate sheets of material. Typically, perforation dies include a lower die plate having an array of punches arranged above the die plate that define a perforation pattern. In use, a sheet of material is placed on the punches of the lower die plate and the sheet is pressed downward onto the punches using a press so as to perforate the sheet of material. A cutting pad is often placed between the sheet of material and the roller press. However, these conventional perforation dies are often not equipped with a proper mechanism for securing a sheet of soft material to reduce the deflection of the material during the punching and unloading process. Thus, when these perforation dies are utilized, the soft sheets of material stretch and/or deform, which results in non-uniform perforation patterns in the material. In addition, the perforation dies can be difficult and costly to manufacture and have fixed perforation patterns, limiting the ability to quickly make complex, variable, and custom patterns.

Therefore, a need exists for a perforation system that reduces the above identified inefficiencies and costs of perforating soft sheets of material.

SUMMARY

In at least one embodiment, a perforation system for perforating a flexible work piece is provided. The perforation system may include a punch tool, a die, and a drive mechanism. The punch tool may have a punch head defining a vertical axis. The punch head may have a first shape. The die may be positioned along the vertical axis and may include an ejection port having a second shape. The drive mechanism may be coupled to the punch tool and may translate the punch head downwardly along the vertical axis to perforate the flexible work piece. The first shape may overlap the second shape to provide punch-to-die contact that may result in a clean cut along or around the perimeter of the second shape of the ejection port.

In at least one embodiment, a method of perforating a flexible work piece is provided. The method may include positioning the flexible work piece adjacent a die having an ejection port defined by a first shape. The flexible work piece may be perforated in a first location with a punch tool having a punch head. The punch head may have a second shape that may overlap the first shape. The flexible work piece may be cut along a perimeter of the first shape or the second shape upon the punch tool striking the die.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

This disclosure relates to a perforation system that perforates sheets of flexible material including, but not limited to, leather, fabric, foam, and the like. The perforation system may be incorporated into a computer numerically controlled (CNC) servo driven ram turret punch press to create customized perforation patterns in the flexible material, in comparison to conventional presses used for rigid sheet applications. Punch and die components of the perforation system may allow the flexible material to be perforated with a clean cut, thereby inhibiting loose threads and undesirable aesthetic looks. In addition, the perforation system may provide a mounting technique that utilizes a stabilizing substrate secured to the flexible material by a releasable adhesive. Accordingly, stretching and deformation of the flexible material sheets may be substantially inhibited during the perforation process.

Figure 1:
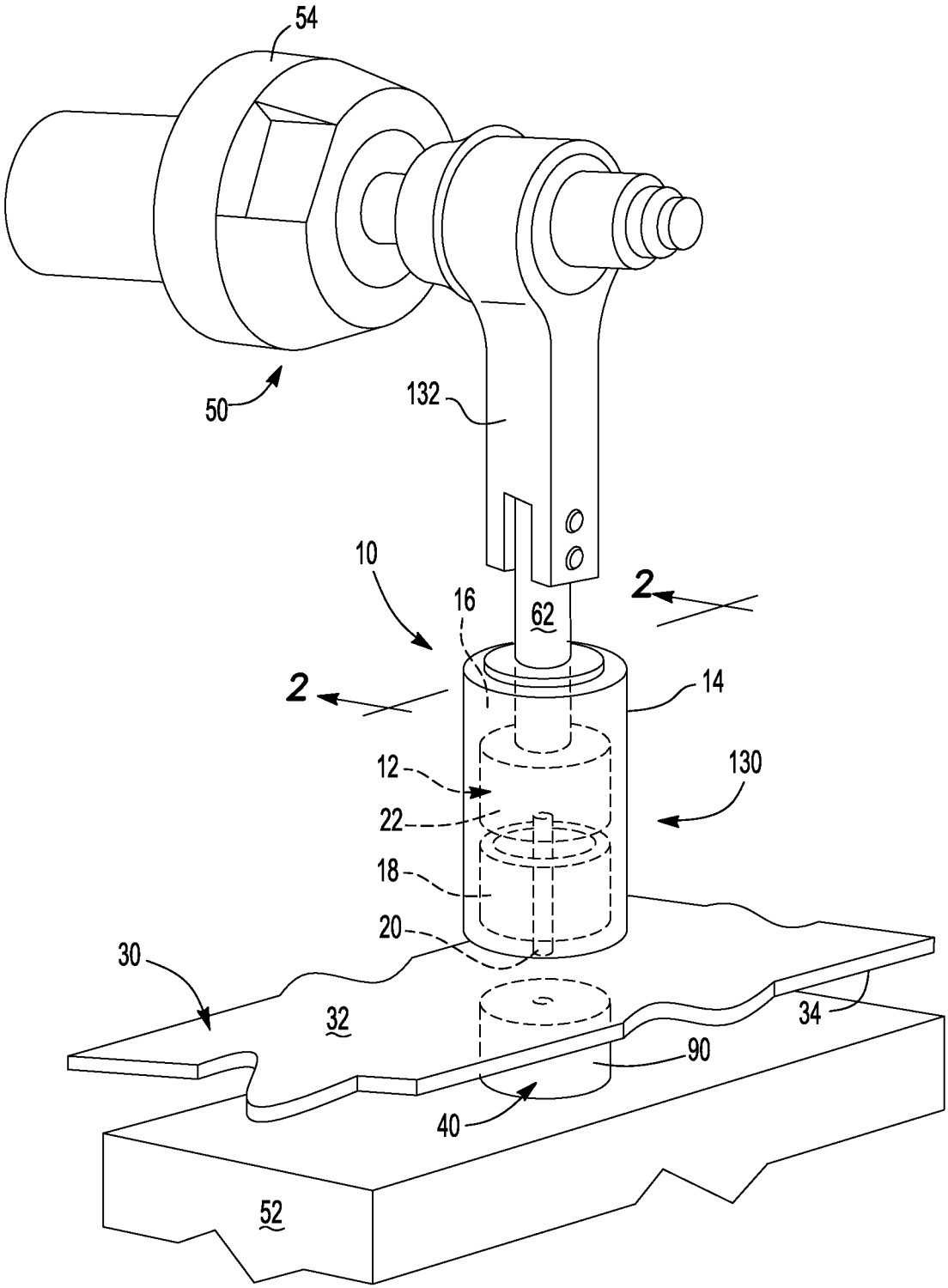
FIG. 1 is a perspective view of a perforation system in a first position according to one embodiment of the invention.

FIG. 1 illustrates a perforation system 10. The perforation system 10 may include a punch tool 12 translatable within a housing 14. The housing 14 may have a cylindrical tube shape and may define a hollow housing cavity 16.

The perforation system 10 may also include a guide member 18 that may be configured to receive a punch head 20 that may extend from a block 22 of the punch tool 12. The block 22 may be moveably received in the housing 14 and may have a cylindrical configuration in one or more embodiments. The punch head 20 may be utilized to perforate or cut holes in a work piece 30. For example, the punch head 20 may perforate or cut a hole in the work piece 30 that may extend from a first surface 32 of the work piece 30 to a second surface 34 of the work piece 30 that may be disposed opposite the first surface 32. The work piece 30 may be a sheet of flexible material constructed of leather, fabric, foam and the like. A die 40 may be positioned adjacent the second surface 34 of the work piece 30 to help support the work piece 30 and to receive the excess material of the work piece 30 after the perforation process is complete.

Figure 2:
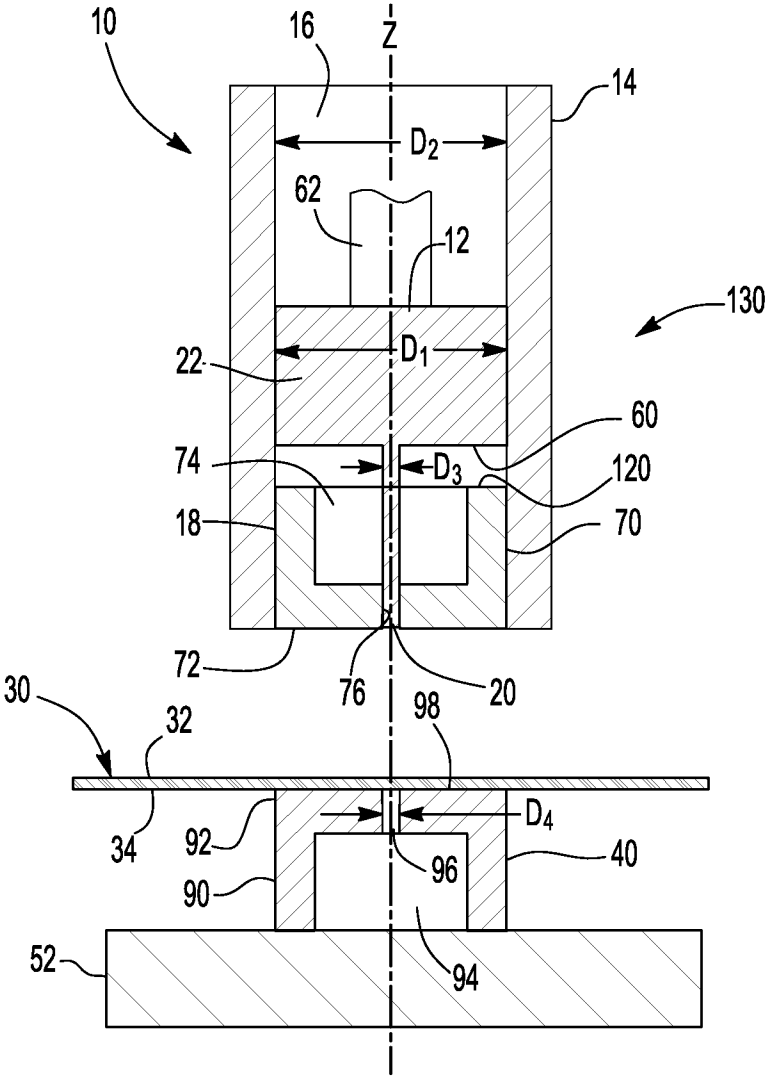
FIG. 2 is a side cross-sectional view take along section line 2-2 of the perforation system of FIG. 1 in the first position.

The perforation system 10 may include a drive mechanism 50. The drive mechanism 50 may be coupled to the punch tool 12 and may be configured to translate one or more punch heads 20 along an axis Z, which is best shown in FIG. 2, to perforate the flexible work piece 30. Axis Z may be a vertical axis. The perforation system 10 may be incorporated into a computer numerically controlled servo driven ram turret punch press 52. The drive mechanism 50 may include or may be coupled to a servo motor 54 that may control movement or translation of the punch tool 12. For instance, the servo motor 54 may control translation of the punch tool 12 along axis Z and move the punch tool 12 by a controllable distance.

Figure 6:
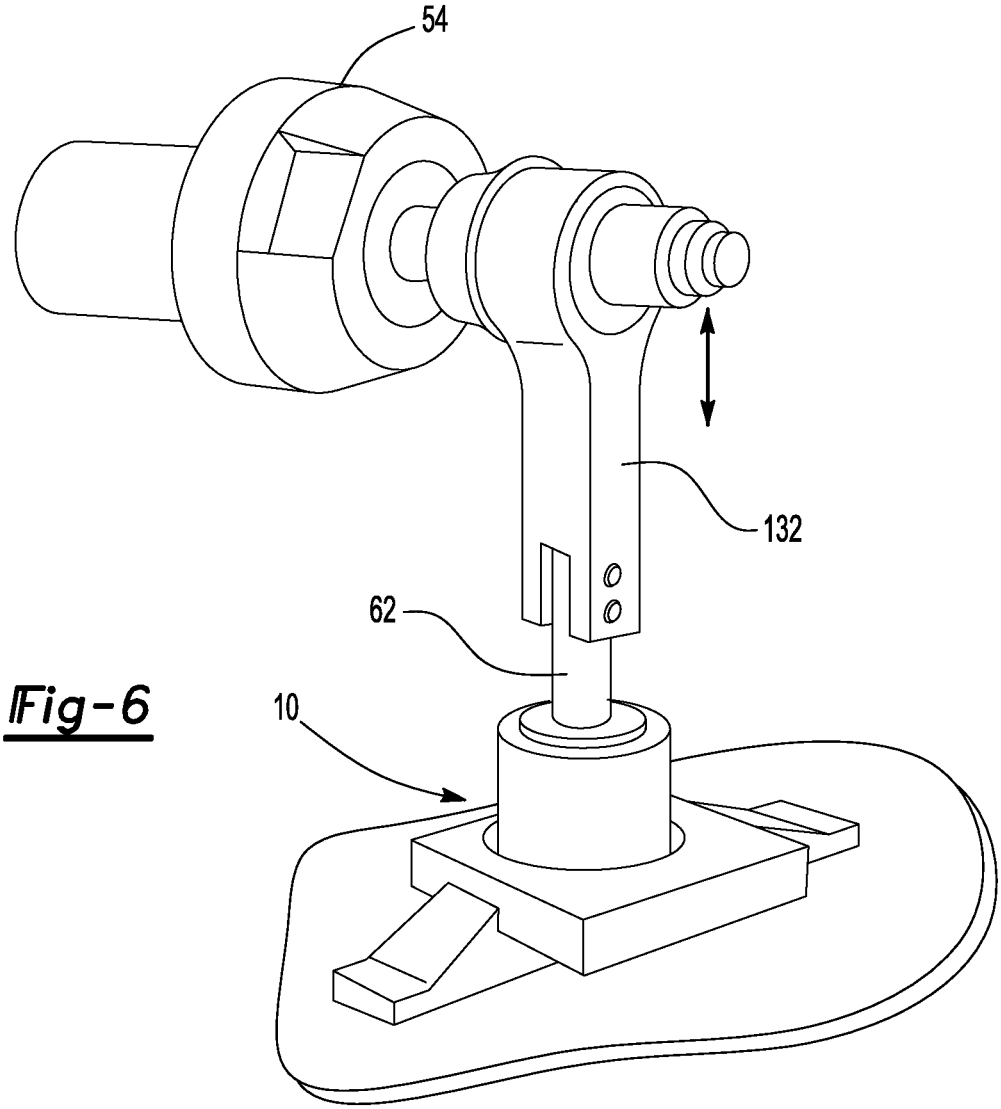
FIG. 6 is a perspective view of a servo drive mechanism configured to actuate the perforation system.

Referring to FIG. 2, the punch head 20 may extend downward from a bottom block surface 60 of the block 22 and may extend along or at least partially define axis Z. In at least one embodiment, the punch head 20 may be integrally formed with the block 22. In other embodiments, the punch head 20 may be a separate component from the block 22 that may be connected to the block 22 by any suitable joining mechanism (e.g., by welding, an adhesive, fastener, interference fit, etc.). As is best shown in FIGS. 1 and 6, the block 22 may be coupled to a ram 62 that may be operatively connected to or in electrical communication with a servo motor 54 that may force the punch head 20 along axis Z through the work piece 30 as will be described in further detail below.

Referring to FIG. 2, the block 22 of the punch tool 12 may have a first diameter $D_1$ that may be between about 1 centimeter and about 15 centimeters. The first diameter $D_1$ may be substantially the same as a second diameter $D_2$ of the hollow housing cavity 16 defined by the housing 14. Thus, the block 22 may translate along the axis Z within the hollow housing cavity 16 to perforate the work piece 30.

The punch head 20 of the punch tool 12 may be an elongate member that may extend along axis Z. The punch head 20 may have a first shape. More specifically, the punch head 20 may be characterized by various different shapes in cross-section taken perpendicular to the axis Z. For example, the shape of the punch head 20 in cross-section may be, but is not limited to, triangular, circular, rectangular, hexagonal, and so on. In some embodiments, the punch tool 12 may include one or more punch heads 20 that may extend from the block 22 and may be arranged in a predetermined pattern of multiple holes (e.g., square, rectangle, triangle, circle, etc.), thereby creating a tile punch that may be used to create a customized perforation pattern. Alternatively, one or more housings 14 may be provided that may each include a punch tool 12 and corresponding guide member 18 within the hollow housing cavity 16 and that may be coupled to the ram 62 to achieve the customized perforation pattern.

In one non-limiting example, if the shape of the punch head 20 is cylindrical, and therefore having a circular cross-section, the punch head 20 has a third diameter $D_3$ that is between about 0.5 millimeters and about 2.5 millimeters, or larger, as shown in FIG. 2. Thus, depending on the shape of the punch head 20, different perforation patterns may be created on the work piece 30. The punch tool 12 may be exchanged with another punch tool 12 to provide perforation patterns having different shapes, and in some embodiments, provide custom perforation patterns using CNC, as will be described in further detail below.

The guide member 18 may have a side wall 70 that may upwardly extend from a bottom wall 72 to create a cavity 74. The side wall 70 may be cylindrical in one or more embodiments. An aperture 76 may be centrally disposed on the bottom wall 72 of the guide member 18 and may extend through the guide member 18. The aperture 76 may be dimensioned substantially the same as, and may be configured to receive, the punch head 20. Thus, the guide member 18 may help align the punch head 20 with the aperture 76 as the punch tool 12 translates along the axis Z to perforate the work piece 30. The guide member may be moveably disposed in the housing 14 and may move along axis Z in one or more embodiments.

Figure 3:
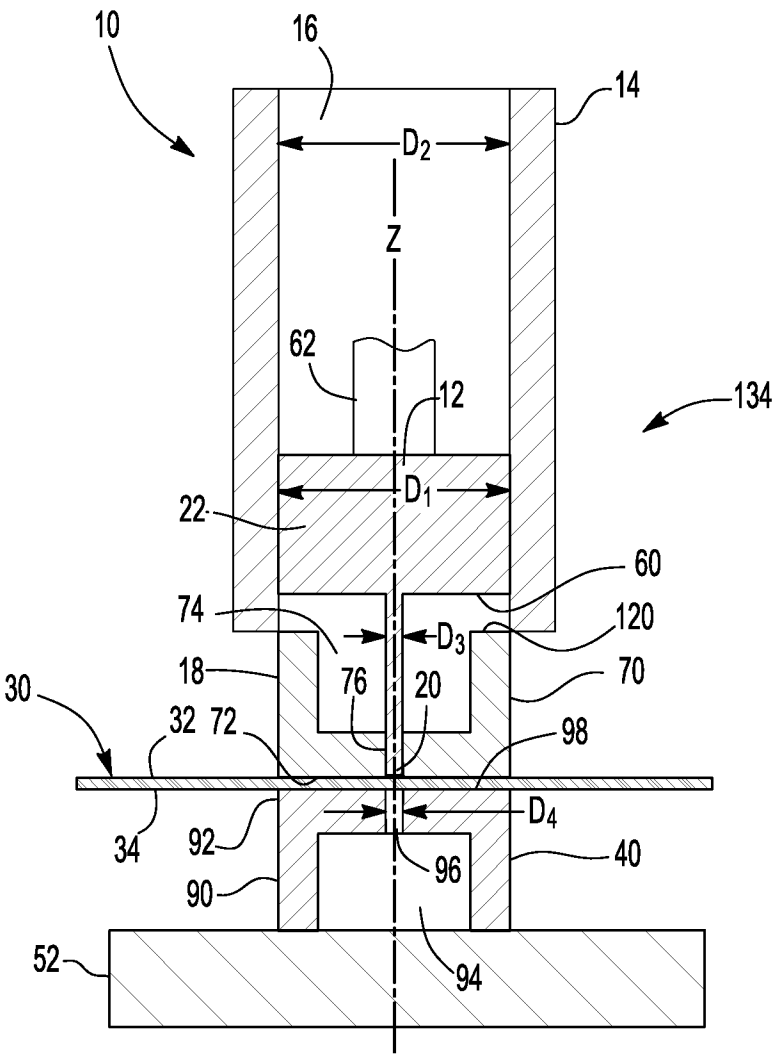
FIG. 3 a side cross-sectional view of the perforation system of FIG. 2 in a second position with a punch tool engaging a work piece to be perforated.

Referring to FIG. 3, the guide member 18 and the punch head 20 are shown abutting the first surface 32 of the work piece 30 prior to advancing the punch head 20 through the work piece 30 to create a perforation. In the position shown in FIG. 3, the guide member 18, among other things, may engage the first surface 32 of the work piece 30 to stabilize the work piece 30 as the punch head 20 approaches the work piece 30 and as the punch head 20 is extracted from the work piece 30. For instance, the guide member 18 may help hold the work piece 30 down to inhibit the punch head 20 from lifting the work piece 30 as the punch head 20 is retracted upward. The guide member 18 may also help support the punch head 20 to withstand lateral force while the punch head 20 is being driven through the work piece 30.

Referring to FIGS. 2 and 3, the die 40 may have a die side wall 90. The die side wall 90 may extend downwardly from a top wall 92 to create a cavity 94. The die side wall 90 may be cylindrical in one or more embodiments. The die 40 may engage and support the second surface 34 of the work piece 30 to inhibit downward deformation of the work piece 30, such as when the punch head is advanced. The top wall 92 may provide lateral positioning for the punch head 20 as it perforates the work piece 30. In some embodiments, the die 40 may be incorporated into a movable base of the CNC servo driven ram turret punch press 52.

Figure 4A:
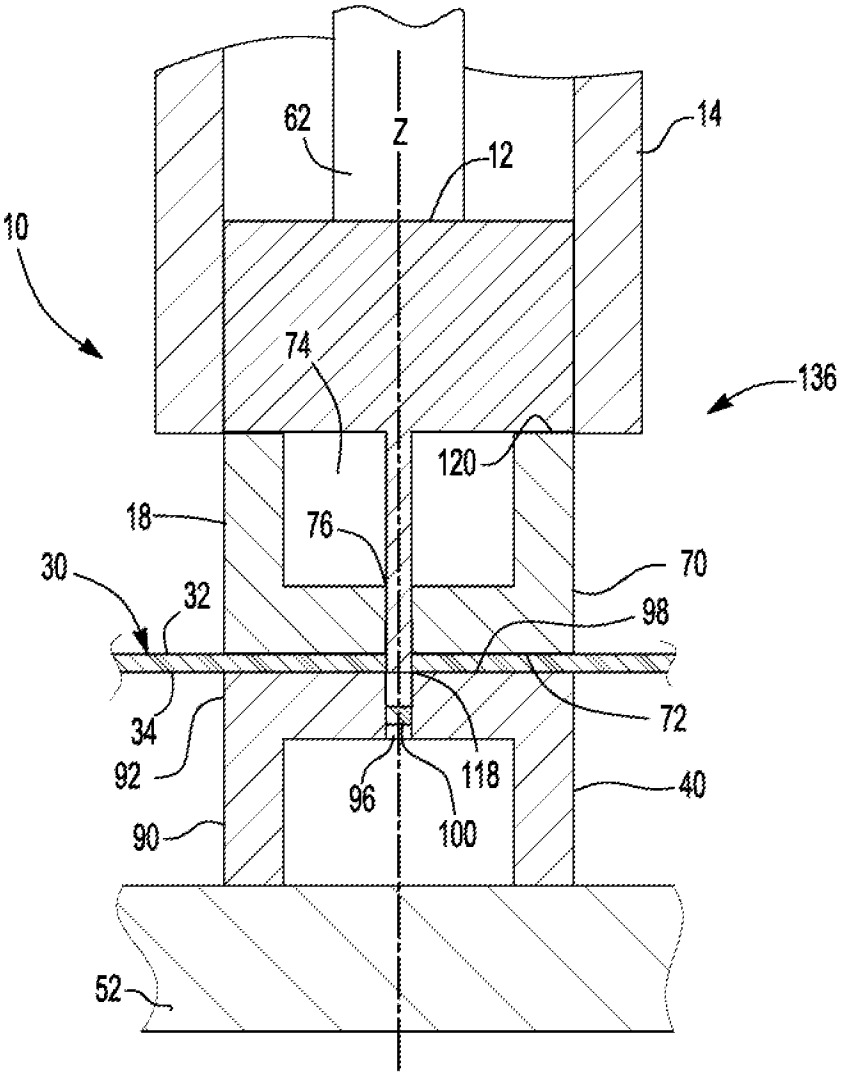
FIG. 4A is an enlarged view of a portion of FIG. 4.
Figure 4:
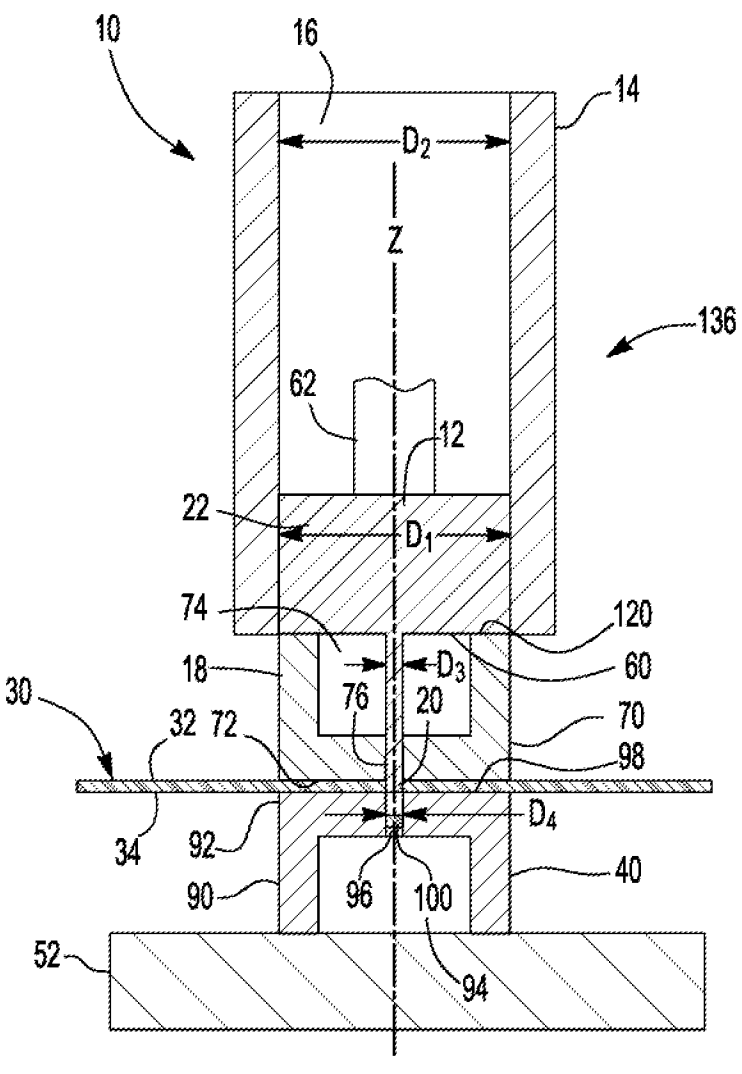
FIG. 4 is a side cross-sectional view of the perforation system of FIG. 2 in a third position with a slug of the work piece being ejected through an ejection port of a die by the punch tool to create a perforation in the work piece.

The die 40 may further include an ejection port 96 that may be centrally disposed on the top wall 92 of the die 40. The ejection port 96 may extend through the top wall 92 and may be disposed along axis Z and aligned with the aperture 76 in the guide member 18. As is best shown in FIG. 4A, the ejection port 96 may receive a slug 100 that is cut from the work piece 30 by the punch head 20. As is best shown in FIG. 4, the ejection port 96 may have a fourth diameter $D_4$ that may be between about 0.5 millimeters and about 2.5 millimeters, or larger. The fourth diameter $D_4$ may be less than the third diameter $D_3$ of the punch head 20, such that the punch head 20 stops translating along the axis Z substantially at a top surface 98 of the die 40 to cleanly cut the work piece 30. The ejection port 96 may have a second shape. The second shape may differ from the first shape in one or more embodiments.

Figure 5A:
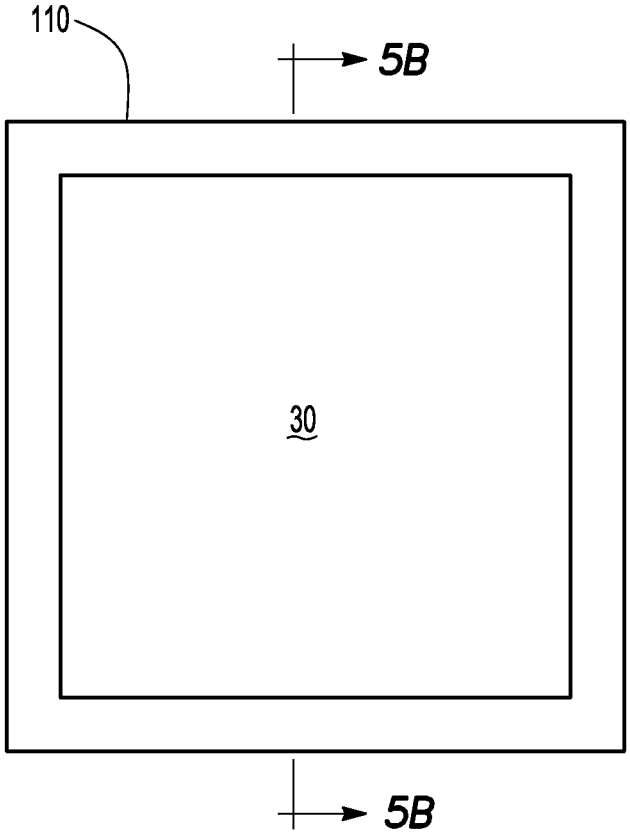
FIG. 5A is a top view of a work piece mounted to a frame in preparation for the work piece to be perforated by the perforation system of FIG. 1.
Figure 5B:
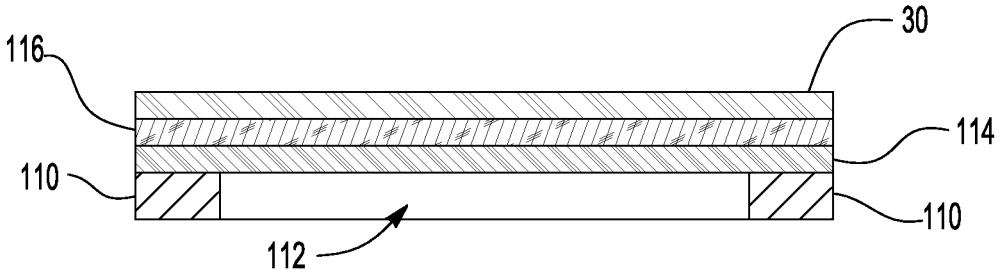
FIG. 5B is a side cross-sectional view taken along line 5B-5B of FIG. 5A of the work piece mounted to the frame using a releasable adhesive and the stabilizing substrate.

Referring to FIGS. 5A and 5B, the work piece 30 may be mounted to a frame 110 in one or more embodiments. The frame 110 may be mounted to a component of the perforation system 10, such as the movable base of the ram turret punch press 52. The frame 110 may be mounted in any suitable manner, such as with one or more clamps. The frame 110 may have an opening 112.

Referring to FIG. 5B, a stabilizing substrate 114 may be disposed on the frame 110 and may extend across the opening 112. The stabilizing substrate 114 may be attached to the frame 110 prior to coupling the work piece 30 to the stabilizing substrate in one or more embodiments, thereby creating a base for the work piece 30. The stabilizing substrate 114 may be attached across the opening 112 of the frame 110 such that the stabilizing substrate 114 exhibits a modulus of elasticity of 2 GPa or greater. Thus, when the force of the punch head 20 is applied to the work piece 30, the stabilizing substrate 114 may limit or inhibit the work piece 30 from deforming along the axis Z. In addition, the stabilizing substrate 114 may help inhibit the work piece 30 from acquiring undesirable deformations (e.g., loose threads).

In one non-limiting example, the stabilizing substrate 114 may be a sheet of material, such as a polyester film (e.g., Mylar®), paper, or any suitable polymeric material sized to fit the frame 110. The stabilizing substrate 114 may extend a portion of the second surface 34 of the work piece 30 or under the entire second surface 34 of the work piece 30. Once the stabilizing substrate 114 is coupled to the frame 110, the work piece 30 may be attached thereto using a releasable adhesive 116, such as a liquid type adhesive, a removable adhesive tape, a double-sided tape, or the like. The releasable adhesive 116 may be dimensioned substantially the same as the work piece 30 in one or more embodiments. Alternatively, the releasable adhesive 116 may be applied completely or partially to an edge portion of the work piece 30 to sufficiently secure the work piece 30 to the stabilizing substrate 114.

By attaching the work piece 30 to the frame 110 in above described manner, the work piece 30 may be perforated and cleanly cut. For instance, the punch head 20 may perforate or cut the work piece 30 and the stabilizing substrate 114 on a perimeter 118 or perimeter edge of the ejection port 96 by "kiss cutting." Kiss cutting is related to the relative size of the diameter $D_3$ of the punch head 20 and the diameter $D_4$ of the ejection port 96. Because the diameter $D_3$ of the punch head 20 is slightly greater than the diameter $D_4$ of the ejection port 96, the ejection port 96 limits or inhibits the punch head 20 from translating down into the ejection port 96 and into the cavity 94 of the die 40. Instead, the punch head 20 may strike the top wall 92 of the die 40 and cut the work piece 30 and the stabilizing substrate 114 along the perimeter 118 of the ejection port 96. Downward translation of the punch head 20 may be controlled by the CNC punch press to limit the impact or impact force of the punch head 20 striking the top wall 92 to prolong the useful life of the punch head 20 and the die 40. Other ways to control the downward travel of the punch head 20 may be employed, such as with a stop 120 that may be formed in the housing 14 or by employing the guide member 18 as a stop 120 when the guide member engages the work piece 30, without departing from the scope of the invention. In embodiments where the ejection port 96 has a non-circular perimeter, such as a geometric or irregular shape, the punch head 20 may extend over (i.e., overlap) the perimeter 118 of the ejection port and may strike the top wall 92 of the die 40 to cut the work piece 30 along the non-circular perimeter, thereby forming a perforation conforming to the non-circular perimeter of the ejection port 96.

In some embodiments, prior to operation, the perforation system 10 may be mounted to a programmable auto-indexable punch press, such as the turret punch press 52. The perforation system 10 may be removable from the turret punch press 52 to allow various shapes and sizes of punch tools 12 to be mounted to the turret punch press 52. The perforation system 10 may be provided with other types of presses, such as mechanical and hydraulic presses as well as CNC punch presses with programmable ram speed and depth. One suitable punch press is a CNC servo motor driven ram turret punch press sold under the Muratec® brand by Murata Machinery, Ltd., as is partially shown in FIG. 6.

The turret punch press 52 may include an upper turret that holds a plurality of punches, such as the punch tool 12 previously described, at locations spaced circumferentially about its periphery, and a lower turret that holds a series of dies, such as the die 40, at locations spaced circumferentially about its periphery. The press or turrets may be rotated about an axis, such as axis Z, to bring a desired punch and die set into vertical alignment. By appropriately rotating the upper and lower turrets, an operator can bring a number of different punch and die sets sequentially into alignment in the process of performing a series of different perforating operations. Also within the turrets, each individual punch and die set may be automatically rotated as desired to achieve different orientations of non-round holes in the work piece to achieve a desired aesthetic effect.

Once the perforation system 10 is mounted into the turret punch press 52, the work piece 30 and frame 110 may be mounted to a movable base of the turret punch press 52, as previously described. The base may be movable in a plane perpendicular the axis Z. The movable base may be in communication with a programmable electronic controller to position the work piece 30 relative to the perforation system 10. The programmable electronic controller may also control the servo motor 54. Thus, the work piece 30 can be located between the upper turret and the lower turret by moving the base in the plane perpendicular to the axis Z.

During operation, the punch tool 12 of the perforation system 10 may begin its cycle of perforating the work piece 30 in a first position 130, as shown in FIG. 2. In the first position 130, both the punch tool 12 and guide member 18 may be disengaged from the work piece 30 and die 40. As previously described, the punch tool 12 may be coupled to the ram 62. On an opposing end, the ram 62 may be coupled to a crank shaft 132. The crank shaft 132 may be driven by the electrical servo motor 54. The electrical servo motor 54 may be controlled by punch program controls or programmable electronic controller to cause a predetermined ram motion (i.e., to rotate or oscillate the crank shaft 132 to carry out punching). A linear transducer, for example, may operatively be connected to the ram 62 and generate position feedback signals which may be used to monitor and control the position and motion of the ram 62.

As the servo motor 54 is actuated, rotation of the crank shaft 132 may cause the ram 62 to exert a downward force on the perforation system 10. The downward force may cause the perforation system 10 to translate along axis Z from the first position 130 shown in FIG. 2 to a second position 134 shown in FIG. 3. In the second position, the punch head 20 and the bottom wall 72 of the guide member 18 may engage the work piece 30 in preparation for the perforation process.

Further downward force due to rotation of the crank shaft 132 may cause the perforation system 10 to further translate along axis Z from the second position 134 to a third position 136 as shown in FIGS. 4 and 4A. More specifically, the downward force caused by the rotation of the crank shaft 132 may continue until the downward axial translation of the ram 62, and thus the punch tool 12, cuts the work piece 30. In the third position 136, the ram 62 may reach its downward most position and the punch head 20 may extend through the work piece 30 substantially to the top wall 92 of the die 40 to make a perforation 140 in the work piece 30. The slug 100 created by the punch head 20 may be ejected through the ejection port 96 of the die 40. However, the punch head 20 may only extend to substantially the top wall 92 of the die 40 as a result of the diameter $D_3$ of the punch head 20 being slightly greater than the diameter $D_4$ of the ejection port 96, thereby providing a clean cut in the work piece 30.

Once the ram 62 reaches its downward most position, rotation of the crank shaft 132 may reverse, thereby causing the ram 62 and the punch tool 12, to translate upward along the axis Z to the first position 130.

The perforation system 10 may translate the frame 110 and work piece 30 with respect to the punch tool 12 and corresponding guide member 18 to perforate the work piece 30 in different locations. For instance, each time the perforation system 10 returns to the first position 130 (i.e., the punch tool 12 and guide member 18 are disengaged from the work piece 30 and die 40), the movable base, and thus the frame 110, may be translated within a plane perpendicular to the axis Z to create a customized perforation pattern 142 on the work piece 30. The plane may be the plane of the work piece 30 or a plane that may include or may be disposed substantially parallel to the first surface 32 or second surface 34 in one or more embodiments.

Figure 7:
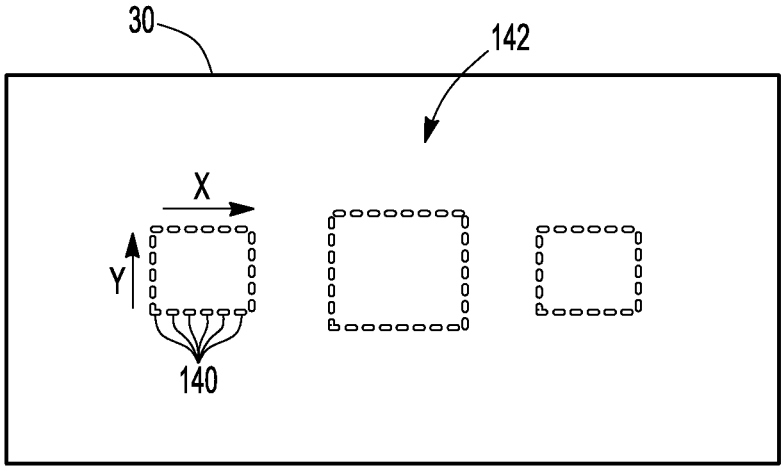
FIG. 7 is a top view of a customized perforation pattern on the work piece.

An example of a perforation pattern 142 is shown in FIG. 7. For example, if the desired perforation pattern is one or more rectangles, the movable base may begin translating in a first direction, as indicated by the arrow Y, within the plane each time after the punch head 20 of the punch tool 12 creates a perforation in the work piece 30. The punch and die tooling may then be rotated 90 degrees and the movable base may be translated as indicated by the arrow X, until the punch head 20 of the punch tool 12 creates the desired perforations in the work piece 30. This process may be repeated until the rectangular perforation pattern is formed in the work piece 30. Alternatively, the punch tool 12 may have a plurality of punch heads 20 that may extend from the block 22 that may form a rectangular tile punch. Thus, the custom perforation pattern 142 shown in FIG. 7 may be achieved in a single punch stroke or with fewer punches as compared to the punch tool 12 having a single punch head 20.

In other embodiments, the base to which the frame 110 is mounted may remain stationary and the punch tool 12 and corresponding die 40 may move with respect to the frame 110 and the work piece 30. For example, if the desired perforation pattern is one or more rectangles, as shown in FIG. 7, the perforation system 10 may translate in a first direction, as indicated by the arrow Y that may be located within the plane after the punch head 20 of the punch tool 12 create a perforation in the work piece 30. The perforation system 10 may then be rotated 90 degrees and translated in the second direction, as indicated by the arrow X, until the punch head 20 of the punch tool 12 creates the desired perforations in the work piece 30. In some embodiments, the perforation system 10 may be in communication with a programmable controller of the CNC machine and configured to rotate the punch tool 12 to create other customized perforation patterns 142 in the work piece 30.

The perforation system 10 described above may allow a variety of reconfigurable perforation patterns to be made in a work piece. This can be useful when products have varying perforation designs, such as varying logos designs and/or varying perforation patterns disposed around or adjacent to the custom logo. In these circumstances, different custom perforation patterns may be provided by the CNC machine for the customized logo and for perforation patterns disposed around or adjacent to the custom logo.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A perforation system for perforating a flexible work piece comprising:

a punch tool having a block that has a bottom surface that faces toward the flexible work piece and a punch head that extends from the bottom surface of the block, the punch head defining a vertical axis and having a first shape;

a housing that defines a housing cavity that receives the punch tool such that the block contacts the housing in the housing cavity and is moveable with respect to the housing along the vertical axis, wherein the housing does not move along the vertical axis;

a guide member that is receivable in the housing cavity, wherein the punch head is received in the guide member;

a die positioned along the vertical axis and having an ejection port defined by a second shape; and a drive mechanism coupled to the punch tool and that translates the block downwardly along the vertical axis so that the bottom surface of the block contacts the guide member and the guide member contacts the flexible work piece and translates the punch head downwardly along the vertical axis to perforate the flexible work piece, wherein the first shape overlaps the second shape to provide for punch-to-die contact which results in a clean cut along a perimeter of the second shape.

2. The perforation system of claim 1 wherein the drive mechanism is coupled to a servo motor and is configured to control downward translation of the punch tool by a controllable distance, wherein the drive mechanism is incorporated into a computer numerically controlled servo driven ram turret punch press and the computer numerically controlled servo driven ram turret punch press manipulates the punch tool to create a customized perforation pattern on the flexible work piece.

3. The perforation system of claim 1 wherein the first shape is circular having a first diameter and the second shape is circular having a second diameter, wherein the first diameter is greater than the second diameter.

4. The perforation system of claim 1 further comprising:

a frame that receives a sheet of stabilizing substrate; and a releasable adhesive positioned between the sheet of stabilizing substrate and the flexible work piece to secure the flexible work piece to the sheet of stabilizing substrate;

wherein the sheet of stabilizing substrate limits perforations of the flexible work piece from deforming when the punch tool perforates the flexible work piece.

5. The perforation system of claim 4 in which the frame includes an opening over which the sheet of stabilizing substrate is disposed.

6. The perforation system of claim 5 wherein the sheet of stabilizing substrate has a modulus of elasticity of 2 GPa or greater when attached over the opening.

7. The perforation system of claim 4 wherein the releasable adhesive includes at least one of a removable adhesive tape, a double sided tape, or a liquid type adhesive.

8. The perforation system of claim 4 wherein the sheet of stabilizing substrate includes at least one of a polyester film, paper, or a polymeric material that contacts a second surface of the flexible work piece.

9. The perforation system of claim 4, in which the flexible work piece includes at least one of a sheet of leather, a sheet of foam, or a sheet of fabric.

10. The perforation system of claim 1 wherein an end of the punch head extends from the bottom surface of the block and the punch head is spaced apart from the housing.

11. The perforation system of claim 1 wherein the guide member engages a first surface of the flexible work piece when the punch head perforates the flexible work piece.

12. The perforation system of claim 11 wherein the punch head extends through the guide member and does not extend into the die when the punch head perforates the flexible work piece.

13. The perforation system of claim 1 wherein the die engages a second surface of the flexible work piece that is disposed opposite a first surface when the punch head perforates the flexible work piece.

14. The perforation system of claim 1 wherein the punch head contacts a top surface of the die and does not extend into the die.

15. The perforation system of claim 14 wherein the flexible work piece is cut along the perimeter of the second shape when the punch tool strikes the top surface of the die.

16. The perforation system of claim 14 wherein the ejection port extends from the top surface of the die and is disposed along the vertical axis and the punch head contacts the top surface of the die and does not extend into the ejection port.

17. The perforation system of claim 1 further comprising a ram that extends from a crank shaft that is coupled to a servo motor to a top surface of the block that is disposed opposite the bottom surface of the block and is partially received in the housing cavity.

18. The perforation system of claim 1 wherein the punch tool actuates the guide member into contact with the flexible work piece before the punch head advances through the flexible work piece to perforate the flexible work piece.

19. The perforation system of claim 18 wherein the guide member has an aperture through which the punch head extends.

20. The perforation system of claim 19 wherein the guide member has a side wall that is arranged around the vertical axis and a bottom wall that extends from the side wall, wherein the bottom wall defines the aperture and the side wall extends around and is spaced apart from the punch head.

* * * * *